US009050805B2

(12) United States Patent
Sakurai et al.

(10) Patent No.: US 9,050,805 B2
(45) Date of Patent: Jun. 9, 2015

(54) PROCESS FOR PRODUCING LIQUID EJECTION HEAD AND PROCESS FOR PRODUCING SUBSTRATE FOR LIQUID EJECTION HEAD INCLUDING REPEATED METAL LAYER, SI LAYER, N LAYER LAMINATIONS

(71) Applicant: CANON KABUSHIKI KAISHA, Tokyo (JP)

(72) Inventors: Makoto Sakurai, Kawasaki (JP); Takuya Hatsui, Tokyo (JP); Souta Takeuchi, Fujisawa (JP); Takeru Yasuda, Oita (JP); Soichiro Nagamochi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/196,159

(22) Filed: Mar. 4, 2014

(65) Prior Publication Data

US 2014/0267502 A1 Sep. 18, 2014

(30) Foreign Application Priority Data

Mar. 14, 2013 (JP) ..... 2013-051814

(51) Int. Cl.

| | |
|---|---|
| ***B41J 2/05*** | (2006.01) |
| ***B41J 2/16*** | (2006.01) |
| ***B41J 2/14*** | (2006.01) |

(52) U.S. Cl.

CPC *B41J 2/16* (2013.01); *B41J 2/1408* (2013.01); *B41J 2/14129* (2013.01); *B41J 2/1603* (2013.01); *B41J 2/1642* (2013.01); *B41J 2/1646* (2013.01)

(58) Field of Classification Search

CPC . B41J 2/14129; B41J 2/14112; B41J 2/14088
USPC ..... 347/20, 44, 47, 56–58, 61–65, 67
See application file for complete search history.

(56) References Cited

U.S. PATENT DOCUMENTS

| | | | | |
|---|---|---|---|---|
| 6,527,813 | B1 * | 3/2003 | Saito et al. | 347/62 |
| 8,129,204 | B2 | 3/2012 | Saito et al. | |
| 2007/0030313 | A1 * | 2/2007 | Min et al. | 347/62 |

FOREIGN PATENT DOCUMENTS

| | | | |
|---|---|---|---|
| JP | 3554148 | A | 5/2004 |

* cited by examiner

*Primary Examiner* — Juanita D Jackson
(74) *Attorney, Agent, or Firm* — Fitzpatrick, Cella, Harper & Scinto

(57) ABSTRACT

The invention provides a liquid ejection head including a member in which an ejection orifice for ejecting a liquid is formed, and a substrate to which the member is joined. The substrate has a heat storage layer containing a silicon compound and an energy-generating element provided at a position corresponding to the ejection orifice for generating heat by electrification to eject the liquid from the ejection orifice. The energy-generating element has a laminate having a metal layer formed of tantalum or tungsten, an Si layer laminated on the metal layer and formed of silicon and an N layer laminated on the Si layer and formed of nitrogen, and the metal layer is in contact with the heat storage layer.

4 Claims, 5 Drawing Sheets

FIG. 3A
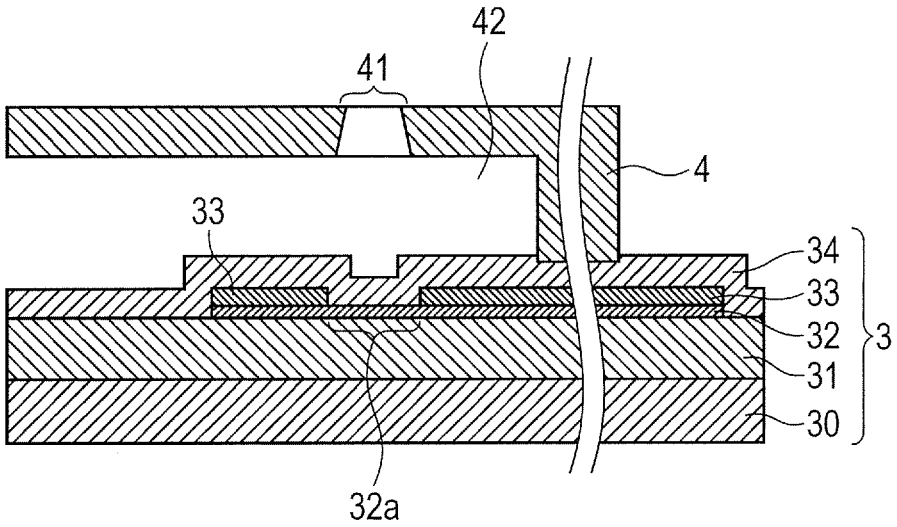
FIG. 3B
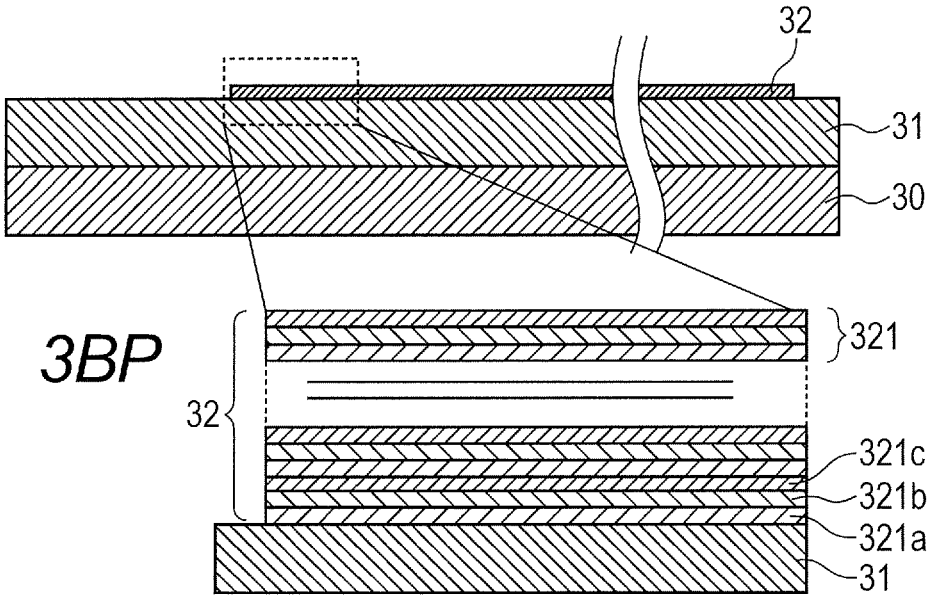
FIG. 3BP

FIG. 5

| | DEPOSITION METHOD | FILM QUALITY EVALUATION | SPECIFIC RESISTANCE ($\mu\Omega \cdot cm$) | STRUCTURE | THERMAL STRESS |
|---|---|---|---|---|---|
| EXAMPLE 1 | ALD (Ta → Si → N) | A | 400 | AMORPHOUS | A |
| EXAMPLE 2 | ALD (W → Si → N) | A | 360 | AMORPHOUS | A |
| COMPARATIVE EXAMPLE 1 | ALD (Si → Ta → N) | A | 360 | CRYSTALLINE | C |
| COMPARATIVE EXAMPLE 2 | ALD (N → Ta → Si) | B | 410 | AMORPHOUS | C |
| COMPARATIVE EXAMPLE 3 | ALD (Si → W → N) | A | 340 | CRYSTALLINE | C |
| COMPARATIVE EXAMPLE 4 | ALD (N → W → Si) | B | 370 | AMORPHOUS | C |
| COMPARATIVE EXAMPLE 5 | SP (Ta33. 3Si33. 3N33. 4) | C | 410 | AMORPHOUS | C |
| COMPARATIVE EXAMPLE 6 | SP (Ta35Si19. 4N45. 6) | C | 825 | AMORPHOUS | B |
| COMPARATIVE EXAMPLE 7 | SP (W33. 3Si33. 3N33. 4) | C | 650 | AMORPHOUS | B |

PROCESS FOR PRODUCING LIQUID EJECTION HEAD AND PROCESS FOR PRODUCING SUBSTRATE FOR LIQUID EJECTION HEAD INCLUDING REPEATED METAL LAYER, SI LAYER, N LAYER LAMINATIONS

BACKGROUND OF THE INVENTION

1. Field of the Invention

The present invention relates to a liquid ejection head from which a liquid is ejected to conduct recording on a recording medium, a recording apparatus provided with the liquid ejection head, a process for producing the liquid ejection head, a substrate for a liquid ejection head and a process for producing the substrate for the liquid ejection head.

2. Description of the Related Art

Ink jet recording apparatus include such a type that a liquid ejection head provided with an energy-generating element for generating energy for ejecting a liquid is installed. In this type of ink jet recording apparatus, it is necessary to use an energy-generating element which is resistant to thermal stress for conducting high-speed recording. Japanese Patent No. 3554148 proposes a TaSiN film deposited by a sputtering method as an energy-generating element which is excellent in thermal responsiveness and has a high sheet resistance.

Such an ink jet recording apparatus as described above has heretofore been used as a consumer device. Specifically, it has been used as an output terminal of an information processing device such as a word processor or a computer. However, the ink jet recording apparatus has been considered to be used as an industrial device in recent years because it has such a feature that a high-definition image is recorded at a high speed.

When the application of the ink jet recording apparatus is an industrial device, the capacity of recording increases compared with the consumer device. As a result, thermal stress applied to an energy-generating element increases. When the thermal stress increases, a resistance change by structural relaxation and oxidation tends to occur, and there is a possibility that the energy-generating element may be disconnected. Therefore, when the application of the ink jet recording apparatus is an industrial device, the energy-generating element is required to have still higher thermal stress resistance.

It is an object of the present invention to provide a liquid ejection head capable of improving the thermal stress resistance of an energy-generating element, a recording apparatus provided with such a liquid ejection head, a process for producing the liquid ejection head, a substrate for a liquid ejection head and a process for producing the substrate for the liquid ejection head.

SUMMARY OF THE INVENTION

The above object can be achieved by the present invention described below.

According to the present invention, there is thus provided a liquid ejection head having a member in which an ejection orifice for ejecting a liquid is formed, and a substrate to which the member is joined, wherein the substrate has a heat storage layer containing a silicon compound and an energy-generating element provided at a position corresponding to the ejection orifice for generating heat by electrification to eject the liquid from the ejection orifice, the energy-generating element has a laminate having a metal layer formed of tantalum or tungsten, an Si layer laminated on the metal layer and formed of silicon and an N layer laminated on the Si layer and formed of nitrogen, and the metal layer is in contact with the heat storage layer.

According to the present invention, there is also provided a recording apparatus comprising the above-described liquid ejection head.

According to the present invention, there is further provided a process for producing a liquid ejection head having a member in which an ejection orifice for ejecting a liquid is formed, and a substrate to which the member is joined and on which a heat storage layer containing a silicon compound is formed, the process including the steps of laminating a metal layer formed of tantalum or tungsten on a surface of the heat storage layer, laminating an Si layer formed of silicon on a surface of the metal layer, and laminating an N layer formed of nitrogen on the Si layer.

According to the present invention, there is still further provided a substrate for a liquid ejection head, including a base on which a heat storage layer containing a silicon compound is formed, and an energy-generating element provided on the side of the heat storage layer for generating energy for ejecting a liquid by electrification, wherein the energy-generating element has a laminate having a metal layer formed of tantalum or tungsten, an Si layer laminated on the metal layer and formed of silicon and an N layer laminated on the Si layer and formed of nitrogen, and the metal layer is in contact with the heat storage layer.

According to the present invention, there is yet still further provided a process for producing a substrate for a liquid ejection head, including the steps of laminating a metal layer formed of tantalum or tungsten on a surface of a heat storage layer containing a silicon compound and formed on a substrate, laminating an Si layer formed of silicon on a surface of the metal layer, and laminating an N layer formed of nitrogen on the Si layer.

Further features of the present invention will become apparent from the following description of exemplary embodiments with reference to the attached drawings.

BRIEF DESCRIPTION OF THE DRAWINGS

FIG. 3A is a sectional view taken along a cutting plane line 3A-3A in FIG. 2, and FIGS. 3B and 3BP are enlarged views of a part thereof.

FIG. 5 is a table showing evaluation results.

DESCRIPTION OF THE EMBODIMENTS

Preferred embodiments of the present invention will now be described in detail in accordance with the accompanying drawings.

A liquid ejection head according to the present invention can be installed in an apparatus such as a printer, a copying machine, a facsimile having a communication system or a word processor having a printer section, and further in an industrial recording apparatus integrally combined with various processors. When the liquid ejection head according to the present invention is used, recording can be performed on various recording media such as paper, thread, fiber, fabric, leather, a metal, a plastic, glass, wood and ceramic.

The term "recording" used in the present specification means not only applying an image having a meaning such as a letter or a figure to a recording medium, but also applying an image having no meaning such as a pattern.

The term "liquid" should be widely interpreted and means a liquid used in formation of, for example, an image, a design or a pattern, processing of a recording medium, or treatment of an ink or a recording medium by applying it on to the recording medium. The treatment of the ink or the recording medium means, for example, a treatment for improving the fixing ability of the ink by solidification or insolubilization of a coloring material in the ink applied to the recording medium, or improving recording quality, color developability or image durability. In addition, such "liquid" as used in a liquid ejection device according to the present invention generally contains a large amount of an electrolyte and has conductivity.

Embodiments of the present invention will hereinafter be described with reference to the accompanying drawings.

The recording apparatus according to the present invention is first described.

Figure 1A:
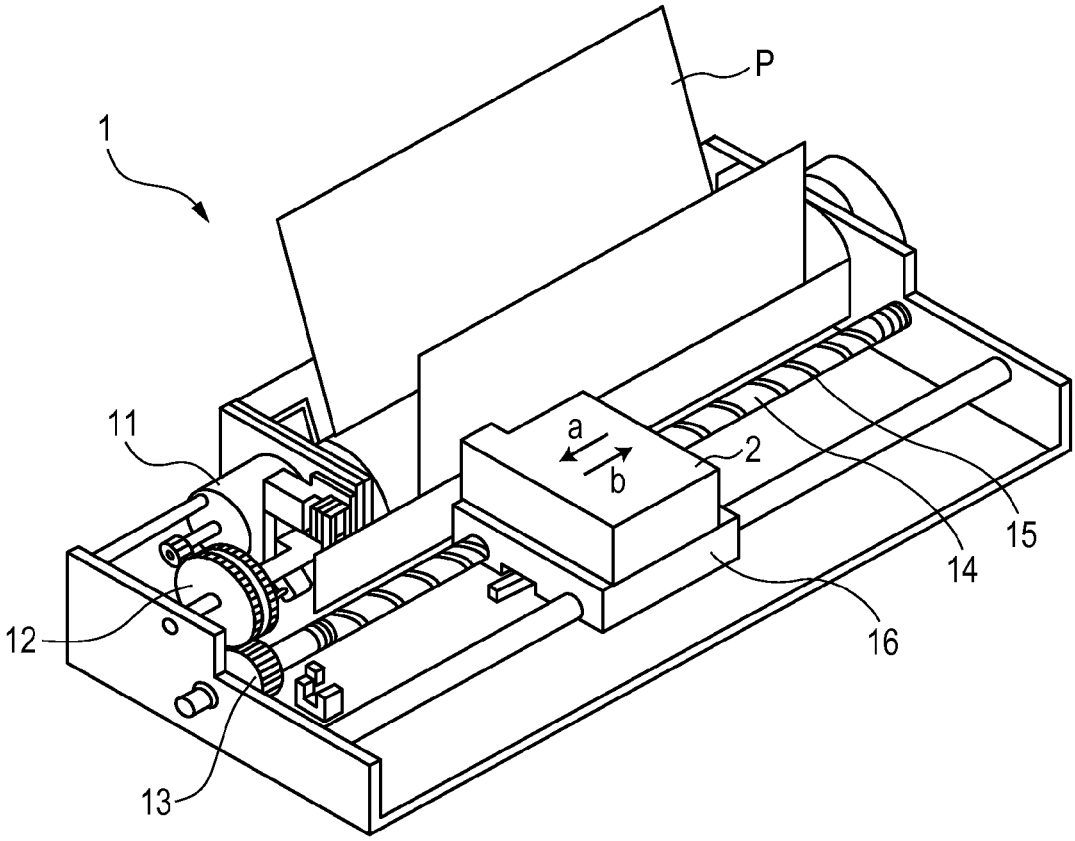
FIGS. 1A and 1B are perspective views of a recording apparatus and a head unit according to the present invention.

FIG. 1A is a perspective view of a recording apparatus according to the present invention. When a drive motor 11 is rotated in a recording apparatus 1 illustrated in FIG. 1A, power is transmitted to a lead screw 14 through driving force transmitting gears 12 and 13, whereby the lead screw 14 is also rotated in conjunction with the rotation of the drive motor 11. A spiral groove 15 is formed in the lead screw 14. A carriage 16 is engaged with the spiral groove 15. When the lead screw 14 is rotated, the carriage 16 is reciprocatingly moved in a widthwise direction (see arrows 'a' and 'b' in FIG. 1A) of a recording medium P. A head unit 2 is mounted on the carriage 16.

Figure 1B:
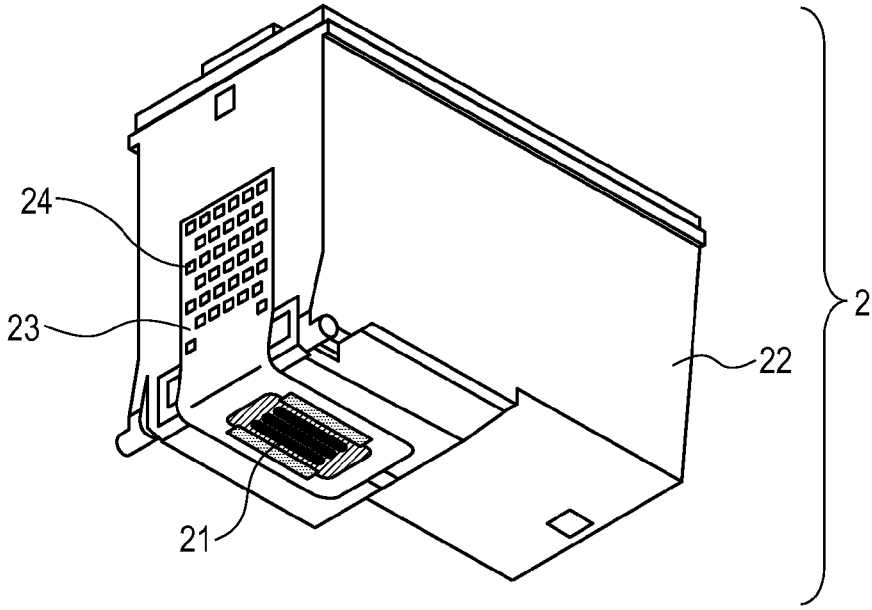

FIG. 1B is a perspective views of a head unit mounted in the recording apparatus illustrated in FIG. 1A. As illustrated in FIG. 1B, a liquid ejection head 21 is in conduction with a contact pad 24 through a flexible film wiring substrate 23. The contact pad 24 is electrically connected to an apparatus body. In this embodiment, the liquid ejection head 21 is integrated with an ink tank 22. However, in the present invention, the ink tank 22 may have a structure separated from the liquid ejection head 21.

The liquid ejection head 21 will hereinafter be described.

Figure 2:
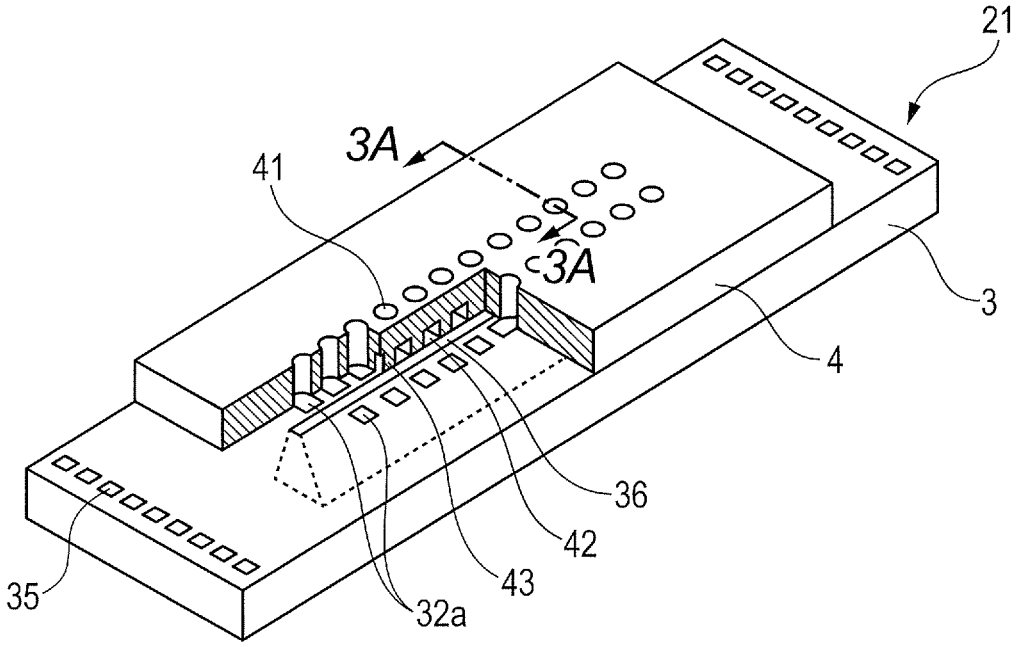
FIG. 2 is a perspective view of a liquid ejection head constituting the head unit illustrated in FIG. 1B.

FIG. 2 is a perspective view of a liquid ejection head constituting the head unit illustrated in FIG. 1B. The liquid ejection head 21 illustrated in FIG. 2 has a substrate 3 (a substrate for the liquid ejection head) provided with energy-generating elements 32*a* and a flow path forming member 4 joined to the substrate 3 and mainly formed of a thermosetting resin such as an epoxy resin. The energy-generating elements 32*a* are arranged at predetermined intervals along a long side direction of a supply port 36 passing through the substrate 3. Plural ejection orifices 41 for ejecting a liquid, plural flow paths 42 communicating with the respective ejection orifices 41, and walls 43 partitioning the respective flow paths 42 are formed in the flow path forming member 4. The ejection orifice 41 is provided at a position corresponding to the energy-generating element 32*a* across the flow path 42. Plural terminals 35 are provided at an end portion of the substrate 3. Electric power for driving the energy-generating element 32*a* and a logic signal for controlling a drive element (not illustrated) such as a transistor are sent to the respective terminals 35 from the apparatus body.

In the liquid ejection head 21 constituted in the above-described manner, liquid is sent to the flow path 42 from the supply port 36. Thereafter, when the energy-generating element generates heat by electrification, the liquid causes film-boiling to produce a bubble. The liquid is ejected from the ejection orifice 41 by a pressure of the bubble, whereby a recording operation is performed.

FIG. 3A is a sectional view taken along a cutting plane line 3A-3A in FIG. 2. As illustrated in FIG. 3A, a heat storage layer 31 is laminated on the surface of a base 30 formed of silicon. The heat storage layer 31 is constituted by a thermal oxidation layer formed by thermally oxidizing a part of the base 30 and a silicon compound formed by using, for example, a CVD (chemical vapor deposition) method. Examples of the silicon compound include SiO, SiN, SiON, SiOC and SiCN. The heat storage layer 31 not only stores heat, but also functions as an insulating layer.

A heating resistor layer 32 is laminated on the surface of the heat storage layer 31. FIGS. 3B and 3BP are enlarged views of a part of FIG. 3A. As illustrated in FIG. 3BP, the heating resistor layer 32 is constituted by plural laminates 321. Each laminate 321 is constituted by a metal layer 321*a*, an Si layer 321*b* laminated on the metal layer 321*a* and an N layer 321*c* laminated on the Si layer 321*b*. The material of the metal layer 321*a* is tantalum (Ta) or tungsten (W). The metal layer 321*a* that is an undermost layer is in contact with the heat storage layer 31. Each laminate 321 is deposited by stacking atoms respectively constituting the metal layer 321*a*, the Si layer 321*b* and the N layer 321*c* one layer after another by an atomic layer deposition (ALD) method.

A pair of electrodes 33 are laminated on the surface (uppermost N layer 321*c*) of the heating resistor layer 32. The material of the pair of electrodes 33 is a material with an electric resistance lower than that of the metal layer 321*a* (for example, aluminum). When a voltage is applied to the pair of electrodes 33, the energy-generating element 32*a* that is a portion located between the pair of electrodes 33 of the heating resistor layer 32 generates heat. In order to insulate the energy-generating element 32*a* and the pair of electrodes 33 from the liquid, an insulating layer 34 is formed. The material of the insulating layer 34 is an insulating material containing a silicon compound such as SiN.

In this embodiment, the flow path forming member 4 is directly joined to the insulating layer 34. However, an adhesion layer formed of, for example, a polyether amide resin may also be formed between the insulating layer 34 and the flow path forming member 4. The use of this adhesion layer improves the adhesion of the insulating layer 34 to the flow path forming member 4.

Examples of the present invention will hereinafter be described.

EXAMPLE 1

Figure 4:
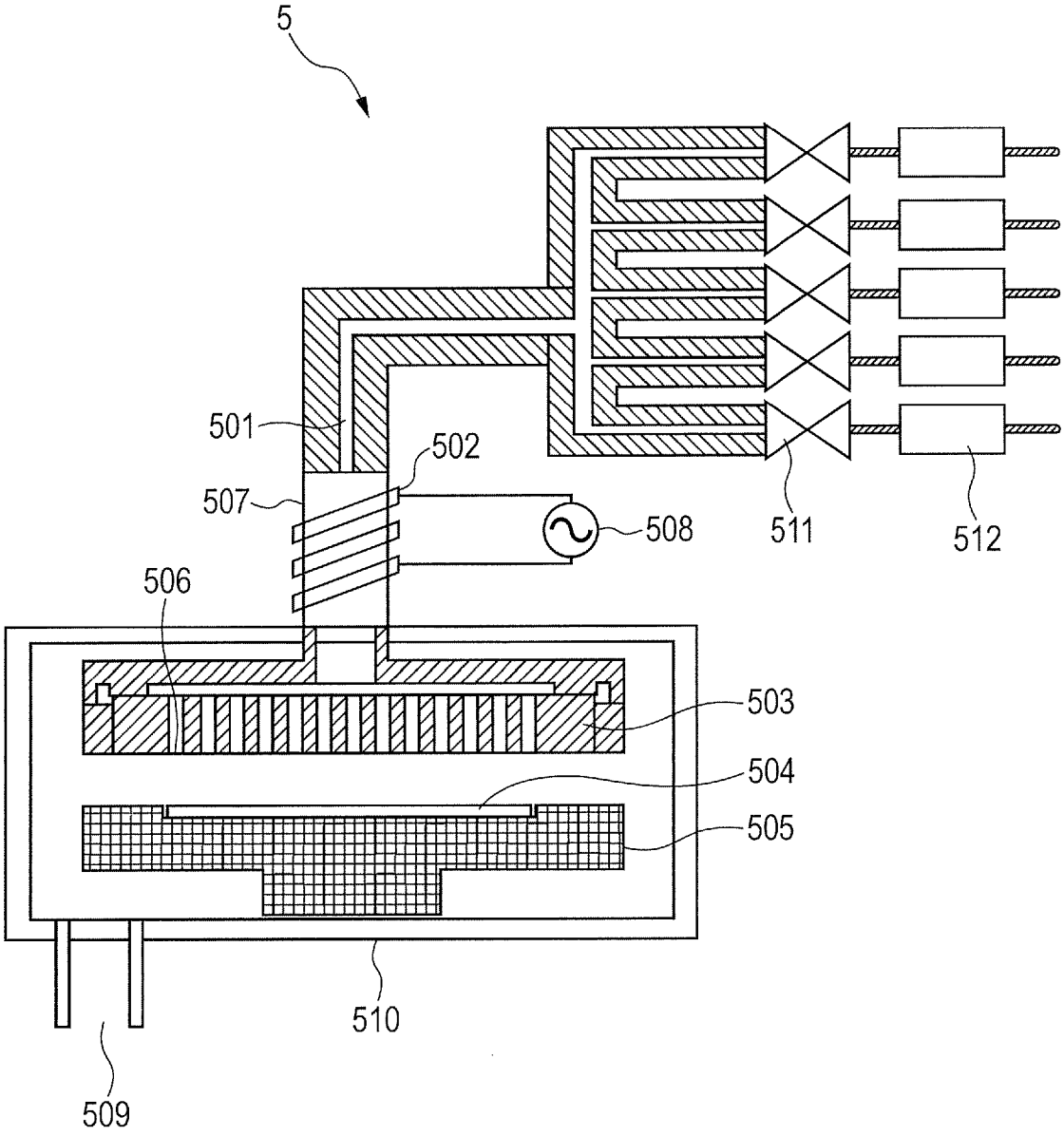
FIG. 4 is a sectional view illustrating the structure of a deposition device according to an atomic layer deposition method.

In this example, a deposition device 5 according to an atomic layer deposition method as illustrated in FIG. 4 is used to form a heating resistor layer 32.

(1) Deposition Process for Metal Layer

In the deposition device 5, $TaCl_5$ (tantalum pentachloride) gas is introduced into a gas introduction port 501 from a valve 511. The $TaCl_5$ gas is generated by heating a container containing $TaCl_5$ and is then discharged with a carrier gas. The $TaCl_5$ gas is fed at a rate of 0.05 to 0.5 g/cycle by setting the introduction time of the carrier gas within a range of 0.5 seconds or more and 8.0 seconds or less. The introduction time of the $TaCl_5$ gas is set within a range of 0.5 seconds or more and 8.0 seconds or less. The $TaCl_5$ gas introduced into the gas introduction port 501 passes through a quartz tube 507. A high frequency power source 508 electrifies a high frequency applying coil 502 upon the passage through the quartz tube 507. The $TaCl_5$ gas is thereby activated. The activated $TaCl_5$ gas is ejected from plural holes 506 formed in a shower plate 503. Thus, $TaCl_5$ is deposited on a substrate 504. The substrate 504 is a member obtained by forming a heat storage layer 31 on the surface of a base 30. In this example, the heat storage layer 31 contains silicon oxide (SiO) deposited by plasma CVD. The substrate 504 is mounted on a stage 505. The stage 505 is heated to 200° C. or more and 400° C. or less. As illustrated in FIG. 4, the shower plate 503 and the stage 505 are arranged within a chamber 510.

After $TaCl_5$ is deposited on the substrate 504, the $TaCl_5$ gas remaining in the chamber 510 is exhausted under reduced pressure from an exhaust port 509. In order to remove Cl (chlorine) constituting $TaCl_5$, hydrogen gas is then introduced into the gas introduction port 501 from the valve 511. The flow rate of the hydrogen gas is controlled to 500 sccm or more and 3,000 sccm or less by the mass flow meter 512. The introduction time of the hydrogen gas is set to 6 seconds or more. The hydrogen gas introduced into the gas introduction port 501 passes through the quartz tube 507. The high frequency power source 508 electrifies the high frequency applying coil 502 upon the passage through the quartz tube 507. The hydrogen gas is thereby activated. The activated hydrogen gas is ejected from the holes 506. Thereupon, the hydrogen reacts with the $TaCl_5$ deposited on the substrate 504. The chlorine (Cl) is removed by this reaction. Thereafter, the hydrogen gas remaining in the chamber 510 is exhausted under reduced pressure from the exhaust port 509. As a result, a metal layer 321*a* formed of tantalum (Ta) is deposited on the surface of the heat storage layer 31. In this example, the thickness of the metal layer 321*a* is $2\times10^{-10}$ m.

(2) Deposition Process for Si Layer

After the metal layer 321*a* is deposited, $SiH_4$ gas is introduced into the gas introduction port 501 from the valve 511. The flow rate of the $SiH_4$ gas is controlled to 80 sccm or more and 500 sccm or less by the mass flow meter 512. The introduction time of the $SiH_4$ gas is set within a range of 2 seconds or more and 30 seconds or less. The $SiH_4$ gas introduced into the gas introduction port 501 passes through the quartz tube 507. The high frequency power source 508 electrifies the high frequency applying coil 502 upon the passage through the quartz tube 507. The $SiH_4$ gas is thereby activated. The activated $SiH_4$ gas is ejected from the holes 506. Thus, Si (silicon) is deposited on the surface of the metal layer 321*a* deposited on the substrate 504. At this time, the stage 505 on which the substrate 504 is mounted is heated to 200° C. or more and 400° C. or less. Thereafter, the $SiH_4$ gas remaining in the chamber 510 is exhausted under reduced pressure from the exhaust port 509. As a result, an Si layer 321*b* formed of silicon is deposited on the surface of the metal layer 321*a*. In this example, the thickness of the Si layer 321*b* is $2\times10^{-10}$ m.

(3) Deposition Process for N Layer

After the Si layer 321*b* is deposited, a mixed gas of nitrogen and hydrogen is introduced into the gas introduction port 501 from the valve 511. The flow rate of the mixed gas is controlled to 150 sccm or more and 3,000 sccm or less by the mass flow meter 512. The introduction time of the mixed gas is set within a range of 10 seconds or more and 30 seconds or less. The mixed gas introduced into the gas introduction port 501 passes through the quartz tube 507. The high frequency power source 508 electrifies the high frequency applying coil 502 upon the passage through the quartz tube 507. The mixed gas is thereby activated. The activated mixed gas is ejected from the holes 506. Thus, nitrogen is deposited on the surface of the Si layer 321*b* formed on the substrate 504. At this time, the stage 505 on which the substrate 504 is mounted is heated to 200° C. or more and 400° C. or less. Thereafter, the mixed gas remaining in the chamber 510 is exhausted under reduced pressure from the exhaust port 509. As a result, an N layer 321*c* formed of nitrogen is deposited on the surface of the Si layer 321*b*. In this example, the thickness of the N layer 321*c* is $1.4\times10^{-10}$ m.

The above-described deposition processes (1), (2) and (3) are performed repeatedly 32 times, thereby completing the heating resistor layer 32 of Example 1. In this example, the thickness of the heating resistor layer 32 is about $200\times10^{-10}$ m. The specific resistance of the heating resistor layer 32 is 400 μΩ·cm.

EXAMPLE 2

In this example, the deposition device 5 is used in the same manner as in Example 1 to form a heating resistor layer 32. Incidentally, regarding the same contents as in Example 1, the description thereof is omitted.

(1) Deposition Process for Metal Layer

In the deposition device 5, $WF_6$ gas is introduced into the gas introduction port 501 from the valve 511. The flow rate of the $WF_6$ gas is controlled to 100 sccm or more and 1,500 sccm or less by the mass flow meter 512. The introduction time of the $WF_6$ gas is set within a range of 1 second or more and 5 seconds or less. The $WF_6$ gas introduced into the gas introduction port 501 passes through the quartz tube 507. The high frequency power source 508 electrifies the high frequency applying coil 502 upon the passage through the quartz tube 507. The $WF_6$ gas is thereby activated. The activated $WF_6$ gas is ejected from the holes 506. Thus, $WF_6$ is deposited on the substrate 504. The substrate 504 is mounted on the stage 505. The stage 505 is heated to 200° C. or more and 400° C. or less.

After $WF_6$ is deposited on the substrate 504, the $WF_6$ gas remaining in the chamber 510 is exhausted under reduced pressure from the exhaust port 509. In order to remove F (fluorine) constituting $WF_6$, hydrogen gas is then introduced into the gas introduction port 501 from the valve 511. The flow rate of the hydrogen gas is controlled to 500 sccm or more and 3,000 sccm or less by the mass flow meter 512. The introduction time of the hydrogen gas is set to 6 seconds or more. The hydrogen gas introduced into the gas introduction port 501 passes through the quartz tube 507. The high frequency power source 508 electrifies the high frequency applying coil 502 upon the passage through the quartz tube 507. The hydrogen gas is thereby activated. The activated hydrogen gas is ejected from the holes 506. Thereupon, the hydrogen reacts with the $WF_6$ deposited on the substrate 504. The fluorine is removed by this reaction. Thereafter, the hydrogen gas remaining in the chamber 510 is exhausted under reduced pressure from the exhaust port 509. As a result, a metal layer 321*a* formed of tungsten (W) is deposited on the surface of the heat storage layer 31. In this example, the thickness of the metal layer 321*a* is $2.8\times10^{-10}$ m.

(2) Deposition Process for Si Layer

An Si layer 321*b* formed of silicon is deposited on the surface of the metal layer 321*a* according to the same process as the process (2) of Example 1.

(3) Deposition Process for N Layer

An N layer 321*c* formed of nitrogen is deposited on the surface of the Si layer 321*b* according to the same process as the process (3) of Example 1.

The above-described deposition processes (1), (2) and (3) are performed repeatedly 33 times, thereby completing the heating resistor layer 32 of Example 2. In this example, the thickness of the heating resistor layer 32 is about $200\times10^{-10}$ m. The specific resistance of the heating resistor layer 32 is 360 μΩ·cm.

COMPARATIVE EXAMPLE 1

In this comparative example, a heating resistor layer was deposited by performing the deposition processes of Example 1 in the order of (2), (1) and (3). That is to say, the heating resistor layer of Comparative Example 1 is a laminate of the order of the Si layer 321*b*, the metal layer 321*a* formed of tantalum and the N layer 321*c*. The deposition processes are performed repeatedly 32 cycles in the above-described order, thereby completing the heating resistor layer of Comparative Example 1. In this comparative example, the thickness of the heating resistor layer is about $200\times10^{-10}$ m. The specific resistance of the heating resistor layer is 360 μΩ·cm.

COMPARATIVE EXAMPLE 2

In this comparative example, a heating resistor layer was deposited by performing the deposition processes of Example 1 in the order of (3), (1) and (2). That is to say, the heating resistor layer of Comparative Example 2 is a laminate of the order of the N layer 321*c*, the metal layer 321*a* formed of tantalum and the Si layer 321*b*. The deposition processes are performed repeatedly 32 cycles in the above-described order, thereby completing the heating resistor layer of Comparative Example 2. In this comparative example, the thickness of the heating resistor layer is about $200\times10^{-10}$ m.

COMPARATIVE EXAMPLE 3

In this comparative example, a heating resistor layer was deposited by performing the deposition processes of Example 2 in the order of (2), (1) and (3). That is to say, the heating resistor layer of Comparative Example 3 is a laminate of the order of the Si layer 321*b*, the metal layer 321*a* formed of tungsten and the N layer 321*c*. The deposition processes are performed repeatedly 32 cycles in the above-described order, thereby completing the heating resistor layer of Comparative Example 3. In this comparative example, the thickness of the heating resistor layer is about $200\times10^{-10}$ m. The specific resistance of the heating resistor layer is 360 μΩ·cm.

COMPARATIVE EXAMPLE 4

In this comparative example, a heating resistor layer was deposited by performing the deposition processes of Example 2 in the order of (3), (1) and (2). That is to say, the heating resistor layer of Comparative Example 4 is a laminate of the order of the N layer 321*c*, the metal layer 321*a* formed of tungsten and the Si layer 321*b*. The deposition processes are performed repeatedly 32 cycles in the above-described order, thereby completing the heating resistor layer of Comparative Example 4. In this comparative example, the thickness of the heating resistor layer is about $200\times10^{-10}$ m.

COMPARATIVE EXAMPLE 5

In this comparative example, a heating resistor layer formed of $Ta_{33.3}Si_{33.3}N_{33.4}$ was deposited by means of a binary sputtering method. Specific deposition conditions are such that the substrate temperature is 150° C., gas flow rate ratio of N/Ar+N is 10%, applied electric power to an Si target is 700 W, and applied electric power to a Ta target is 480 W. In this comparative example, the specific resistance of the heating resistor layer is 410 μΩ·cm.

COMPARATIVE EXAMPLE 6

In this comparative example, a heating resistor layer formed of $Ta_{35}Si_{19.4}N_{45.6}$ was deposited by means of the binary sputtering method. Specific deposition conditions are such that the substrate temperature is 150° C., gas flow rate ratio of N/Ar+N is 18%, applied electric power to an Si target is 650 W, and applied electric power to a Ta target is 480 W. In this comparative example, the specific resistance of the heating resistor layer is 410 μΩ·cm.

COMPARATIVE EXAMPLE 7

In this comparative example, a heating resistor layer formed of $W_{33.3}Si_{33.3}N_{33.4}$ was deposited by means of the binary sputtering method. Specific deposition conditions are such that the substrate temperature is 150° C., gas flow rate ratio of N/Ar+N is 15%, applied electric power to an Si target is 700 W, and applied electric power to a tungsten (W) target is 410 W. In this comparative example, the specific resistance of the heating resistor layer is 650 μΩ·cm.

Film Quality Evaluation

The film qualities of the heating resistor layers of the respective examples and the film qualities of the heating resistor layers of the respective comparative examples were evaluated by means of TEM (transmission electron microscope). Evaluation results are illustrated in FIG. 5. In FIG. 5, a heating resistor layer in which atoms (Ta or W, Si and N) are deposited layeredly one layer after another is evaluated as "A". A heating resistor layer in which the atoms are partially layeredly deposited is evaluated as "B". A heating resistor layer in which the atoms are not deposited layeredly is evaluated as "C".

When referring to FIG. 5, Comparative Examples 2 and 4 are evaluated as "B". In Comparative Examples 2 and 4, the nitrogen atom is unevenly deposited on silicon oxide (SiO) of the heat storage layer 31, so that the film qualities thereof are poor compared with Examples 1 and 2. In Comparative Examples 5 to 7, the film quantities are evaluated as "C". Since the sputtering method is employed in Comparative Examples 5 to 7, the respective atoms are arranged at random. That is to say, the heating resistor layers of Comparative Examples 5 to 7 are composed of a single layer in which the tantalum (or tungsten) atom, the silicon atom and the nitrogen atom are mixedly present.

Structure Evaluation

The structures of the heating resistor layers of the respective examples and the structures of the heating resistor layers of the respective comparative examples were evaluated by means of XRD (X-ray diffraction). Evaluation results are illustrated in FIG. 5. When referring to FIG. 5, a heating resistor layer in the case where the atom in contact with the heat storage layer 31 (silicon compound) is a metal (tantalum or tungsten) or nitrogen has an amorphous structure. On the other hand, a heating resistor layer in the case where the atom in contact with the heat storage layer 31 (silicon compound) is silicon has a crystalline structure.

Thermal Stress Evaluation

Liquid ejection heads respectively having the heating resistor layers of the respective examples and the respective comparative examples were prepared according to the above-described constitution to make thermal stress evaluation (constant stress test). In this thermal stress evaluation, a voltage pulse is applied to each energy-generating element at a predetermined frequency. The peak value of the voltage pulse is a value of 1.3 times as much as a threshold voltage ($V_{th}$) for ejecting an ink. The voltage pulse width is 0.8 μs. Such a voltage pulse is continuously applied until the energy-generating element is disconnected. Evaluation results are shown in FIG. 5. In FIG. 5, the thermal stress resistance is evaluated as "A" in the case where the number of pulses (referred to as "the number of pulses upon the disconnection") when the energy-generating element caused disconnection exceeds $2\times10^{10}$. The thermal stress resistance is evaluated as "B" in the case where the number of pulses upon the disconnection exceeds $5\times10^{9}$. The thermal stress resistance is evaluated as "C" in the case where the number of pulses upon the disconnection is $1\times10^{9}$ or less. When referring to FIG. 5, the thermal stress resistance when the atoms are deposited layeredly is superior to the case where the atoms are partially layeredly deposited, or the atoms are not deposited layeredly, and the thermal stress resistance in the case where the heating resistor layer has the amorphous structure is superior to the case where the heating resistor layer has the crystalline structure.

As apparent from the evaluation results of the film quality, the metal layer 321*a* or the Si layer 321*b* requires to come into contact with the heat storage layer 31 containing the silicon compound in order to deposit the heating resistor layer layeredly on the surface of the heat storage layer 31. When the metal layer 321*a* comes into contact with the heat storage layer 31, the heating resistor layer has an amorphous structure. When the Si layer 321*b* comes into contact with the heat storage layer on the other hand, the heating storage layer has a crystalline structure. The amorphous structure is excellent in thermal stress resistance compared with the crystalline structure because the amorphous structure has no grain boundary. In addition, the heating resistor layer deposited by stacking plural atoms layeredly is harder to cause structural relaxation by thermal stress than the heating resistor layer deposited by the sputtering method.

Accordingly, by bringing the metal layer 321*a* into contact with the surface of the heat storage layer 31 and depositing the metal layer 321*a*, the Si layer 321*b* and the N layer 321*c* layeredly, the thermal stress resistance can be improved. As a result, reliability against the thermal stress can be ensured even when the capacity of recording increases.

According to the present invention, the thermal stress resistance of the energy-generating element can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-051814, filed Mar. 14, 2013, which is hereby incorporated by reference herein in its entirety.

What is claimed is:

1. A process for producing a liquid ejection head having a member in which an ejection orifice for ejecting a liquid is formed, and a substrate to which the member is joined and on which a heat storage layer containing a silicon compound is formed, the process comprising the steps of:

laminating a metal layer formed of tantalum or tungsten on a surface of the heat storage layer, laminating an Si layer formed of silicon on a surface of the metal layer, and laminating an N layer formed of nitrogen on the Si layer, wherein the step of laminating the metal layer, the step of laminating the Si layer and the step of laminating the N layer are performed plural times in this order.

2. The process according to claim 1, wherein the metal layer, the Si layer and the N layer are formed by an atomic layer deposition method.

3. A process for producing a substrate for a liquid ejection head, comprising the steps of:

laminating a metal layer formed of tantalum or tungsten on a surface of a heat storage layer containing a silicon compound and formed on a substrate, laminating an Si layer formed of silicon on a surface of the metal layer, and laminating an N layer formed of nitrogen on the Si layer, wherein the step of laminating the metal layer, the step of laminating the Si layer and the step of laminating the N layer are performed plural times in this order.

4. The process according to claim 3, wherein the metal layer, the Si layer and the N layer are formed by an atomic layer deposition method.

* * * * *